United States Patent [19]

Skard

[11] Patent Number: 4,790,562

[45] Date of Patent: Dec. 13, 1988

[54] SKI POLE HANDLE DEVICE

[76] Inventor: Halldor Skard, Ankerveien 42, Oslo, Norway

[21] Appl. No.: 110,858

[22] Filed: Oct. 21, 1987

[30] Foreign Application Priority Data

Oct. 28, 1986 [NO] Norway ..... 864260
Feb. 18, 1987 [NO] Norway ..... 870637

[51] Int. Cl.[4] ..... A63C 11/22

[52] U.S. Cl. ..... 280/821; 74/523; 135/65; 135/72; D21/230

[58] Field of Search ..... 280/821, 822, 819, 820; D8/307; D21/230; 16/111 R, 121; 74/523, 543, 551.9; 124/20 R, 23 R, 88, 89; 273/81 R, 81 B, 81 D, 81.3, 83; 135/65, 72

[56] References Cited

U.S. PATENT DOCUMENTS 2,183,975 12/1939 Savage ..... 135/66
4,402,529 9/1983 Cavazza ..... 280/816
4,597,589 7/1986 Fujii et al. ..... 280/821
4,601,302 7/1986 Breen et al. ..... 135/66
4,613,156 9/1986 Lajos ..... 280/821
4,641,857 2/1987 Gailiunas ..... 280/821

FOREIGN PATENT DOCUMENTS 0081439 9/1982 European Pat. Off. .
2223273 12/1972 Fed. Rep. of Germany .
146938 2/1981 Norway .

*Primary Examiner*—David M. Mitchell
*Assistant Examiner*—Eric Culbreth
*Attorney, Agent, or Firm*—Bacon & Thomas

[57] ABSTRACT

Ski pole handle device comprising laterally protruding elements (4.1, 4.2) which form supporting surfaces (5.1, 5.2) for the palm of the hand and the thumb, respectively. The support surface for the palm of the hand extends sloping downwardly in a direction away from the handle, and the second element which forms a supporting surface for the thumb protrudes laterally mainly oppositely of the first element, and a knob (6) rises between the elements and a strap (3) fastened to the knob at a position higher than the supporting surfaces.

6 Claims, 1 Drawing Sheet

Fig. 1.
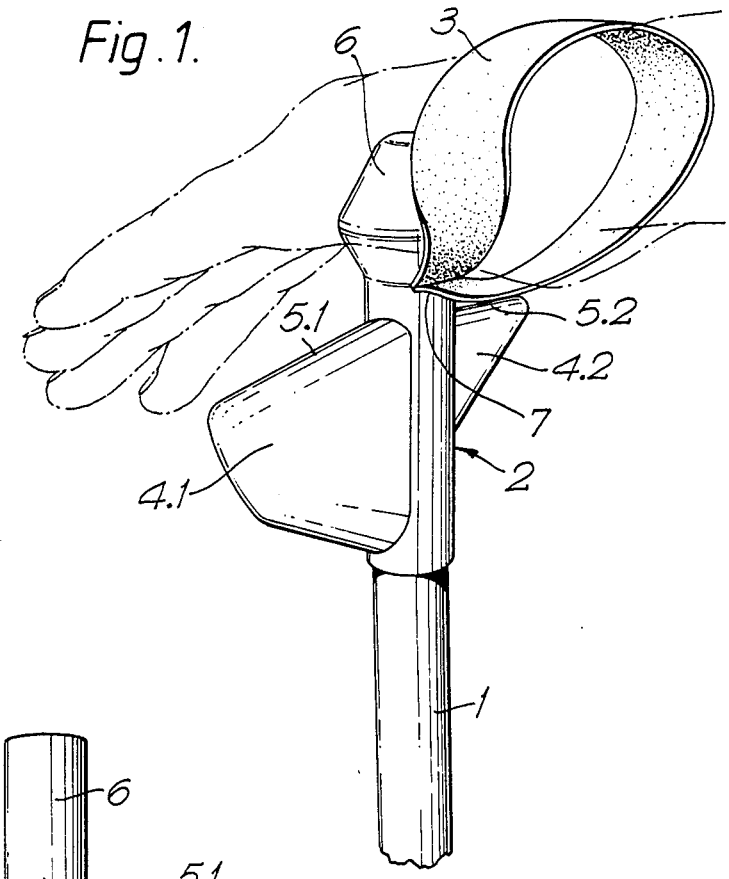
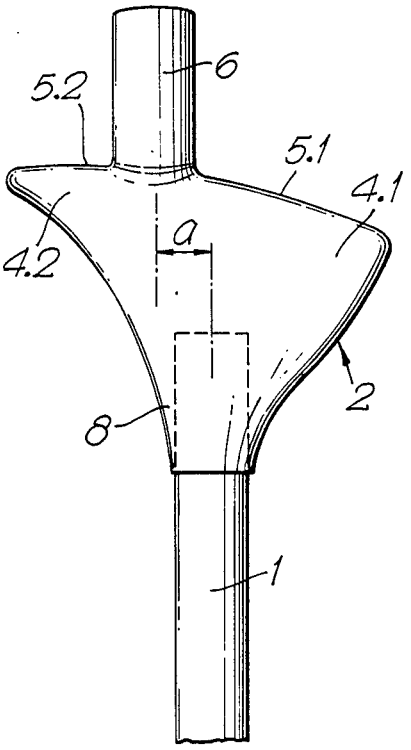
Fig. 2.

SKI POLE HANDLE DEVICE

The present relates to a ski pole handle device.

Traditional ski pole handles have a mainly cylindrical portion around which the hand grips, whereby the palm of the hand becomes approximately vertical. Thereby, the knuckles in the hand will be pressed towards each other during the strokes of the poles, whereby also the muscles will be compressed and are easily exposed to fatigue. By use of conventional pole handles the load on the musculus triceps will be largest. An object of the present invention is to activate a larger number of muscles and muscle fibres, which are able to work during the strokes of the poles.

Among disadvantages which appear during use of traditional pole handles are mentioned the following:

1. An effective "hanging" phase during snow skating is prevented.
2. They do not give an optimum support of the hand during the stroke. This in particular applies to the first part of the stroke.
3. They do not give the skier god premises for bringing the weight of the body forward.
4. The strap tends to slide and to be situated too high on the back of the hand.
5. It is difficult to perform a stroke while keeping the elbow well out laterally during the first part of the stroke.
6. The wrist tends to assume bent positions.
7. The control of the poles tends to be lost during the pivoting phase.
8. The skier's metacarpus is exposed to fatigue when pushing powerfully against the pole.

The object of the present invention is to achieve a ski pole handle device which eliminates or to a large extent reduces the above disadvantages.

In accordance with the invention the above object is achieved by means of a ski pole handle device which comprises a laterally protruding element which forms a supporting surface for the palm of the hand, said device being characterized in that said support surface extends sloping downwardly in a direction away from the handle, and that a second element which forms a supporting surface for the thumb protrudes laterally in a direction mainly oppositely of the first element, and that a knob rises between said elements and has fastening means for a strap situated higher than said supporting surfaces.

Preferably, the element for the palm of the hand has a substantially longer supporting surface than the element for the thumb. Consequently the elements on the handle are asymmetrical. During a stroke a skier will produce a pushing force transferred both from the palm of the hand and from the thumb, and the center of the force will be situated in a vertical plane in a distance from the pole axis when the pole itself is fastened in a ferrule having the same axis as the rising knob which forms a partition between the two supporting elements. The center of the pushing force is, however, in a distance from the knob, and consequently, the pushing force is not coaxial with the axis of the pole itself. The result is that the pushing force produces a bending moment in the pole. Even when the pole has a high stiffness it will necessarily be bent somewhat because of said bending moment. When the pushing force diminishes the pole will straighten because of its elasticity. The energy used to bend the pole in each stroke must be performed by the skier, and said energy means a waste which in particular for competition skiers is of a certain importance.

By means of an embodiment of the present invention the above disadvantage is mainly eliminated, and said embodiment is characterized in that the axis of the portion for fastening of the pole is laterally displaced relatively to the axis of the knob.

By the above embodiment is achieved, due to the asymmetry of the handle, that no significant bending moment is transferred to the pole, and it is achieved that the waste of energy which would otherwise take place because of the work of repeatingly bending the pole is eliminated.

The distance between the axes of the portion for fastening of the pole and the knob, respectively, must. in order to achieve optimum results, be adapted to the user's hand. For the majority of users it is supposed that the distance should be in the range of 5 to 25 mm, without this being mentioned as a limitation of the scope of the invention.

The invention will in the following be explained more thoroughly, with reference to the accompanying drawings.

FIG. 1 shows a first embodiment of a device in accordance with the invention, seen obliquely from behind, whereby a hand being about to grip the device is indicated.

FIG. 2 shows a second embodiment of the device.

FIG. 1 shows the upper end of a ski pole 1, having a handle 2 and a strap 3. The user's hand is indicated by broken lines. The drawing shows a left hand pole. Protruding laterally from the handle portion 2 are elements 4.1 and 4.2. The upper surface 5.1 of the element 4.1 is sloping in the direction outwardly from the pole, and the upper surface 5.2 on the element 4.2 for the thumb is mainly an extension of the element 4.1. The upper surface 5.1 may for instance be at an angle with the pole axis in the order of 60°, the upper surface 5.1 sloping in the direction outwardly from the pole. The upper surfaces 5.1 and 5.2 start in a certain distance from the top of the handle, whereby a knob 6 rises above the elements 4.1 and 4.2.

By means of the elements 4.1 and 4.2 which protrude to the left and the right of the handle the hand of the user is given adequate support during the strokes. The hand lies with the thumb resting on the element 4.2 and the remaining fingers around the upper surface of the element 4.1. Thereby the palm of the hand lies more horizontally than by use of a conventional pole handle. As a result of this knuckles and muscles in the hand will no longer work squeezed together in the same degree as by the use of a conventional handle, and there is less danger of fatigue and cramplike conditions in the musculature. Moreover, other muscles in the back having their attachment in the arm will get better working conditions and thereby develop and transfer a larger force to the pole.

The thumb support 4.2 is convenient for achieving a desired balance between the moments on each side of the pole relatively to the force direction. This balance of moments prevents that bending moments occur in the pole tube during the stroke and corresponding loss of energy in the transfer of force from the arm and through the pole for causing velocity in the direction of movement. The thumb support is convenient for controlling the pole during the pivoting phase both by classic cross country racing and snow skating.

By means of pole handles according to the invention is obtained the possibility of achieving the following advantageous effects:

(a) To give the propulsive muscles or groups of muscles optimized working conditions during the strokes, to increase the stroke impulse.
(b) To increase the ability to develop force and the ability to vary the work during different strokes.
(c) To give muscles in the back which are attached in the arm better working conditions in the start of the strokes. To increase the distance between the origin and the attachment of the muscles prior to the working phase of the pole.
(d) To prevent that the arm and the elbow are lowered too early in the first part of the stroke. To facilitate "getting over" the poles.
(e) To increase the possibility of "hanging" heavily on the poles, in particular during the "hanging" phase when "paddling" during uphill snow skating.
(f) Better control of the poles in the special "combiskate technique" when the pole tips are pointing forwardly.
(g) To increase the ability of keeping the balance during varying skiing. Increased feeling of support on the poles.
(h) To prevent that the strap slides up along the back of the hand.
(i) To decrease the pressure against the metacarpal knuckles when "hanging" heavily on the poles.

It is possible to grip with the four outermost fingers above the element 4.1 and with the thumb above the element 4.2. Thereby, the stroke will be performed with the palm of the hand more horizontal than earlier, and the grip will be changed from an initial position with an almost vertical palm (when using conventional handles) to an almost horizontal palm.

The elements 4.1 and 4.2 give increased control during the entire path of movement during the "hanging" phase, the pulling phase, the pushing phase and the pivoting phase.

First of all the elements 4.1 and 4.2 provide a support surface below the hand, and the elements may in the principle be constituted by a short rod, for instance about 8 cm long and protruding slopingly from the handle. From structural and strength reasons it is, however, appropriate to make the elements 4.1 and 4.2 as a kind of bead, which may be hollow, whereby the element is better suited to be fastened to the pole handle in such a manner that fastening is able to withstand the loadings which occur during use. Thus, the elements 4.1 and 4.2 may have a relatively large length in the longitudinal direction of the handle, for instance 5 to 8 cm.

It is also possible to make the elements 4.1 and 4.2 integrally with the remainder of the handle, for instance by casting of plastics or carving of cork. Other materials may of course also be used.

The elements 4.1 and 4.2 may also be shaped as an approximately U-shaped bail having a sloping, outwardly protruding upper portion.

A device according to the invention can be used for all types of skiing, also including Telemark skiing and alpine skiing.

The elements 4.1 and 4.2 may be at an angle to each other, seen in the longitudinal direction of the pole. For instance the element 4.1 may protrude somewhat forwardly in the user's direction of movement, while the element 4.2 may protrude mainly laterally.

FIG. 2 shows, approximately in full scale, a ski pole handle 2 comprising two laterally protruding elements 4.1 and 4.2 adapted to provide supporting surfaces for the four parallel fingers of a hand and/or the palm of the hand and for the thumb, respectively. Thus, the handle shown may be a handle for the right hand, seen from the rear (i.e. in the direction of movement) or a handle for the left hand seen from the forward. Between the elements 4.1 and 4.2 a knob 6 protrudes upwardly and forms a partition between the thumb and the remaining fingers. The upper end of a pole 1 is fastened in a lower portion 8 of the handle. The location of the knob 6 and the portion 8 for the fastening of the pole 1 is such that there is a distance a between the middle axes of the knob 6 and the portion 8, respectively. In the embodiment shown the distance a is approximately 15 mm, but it may be more or less than this.

Thus, when a skier makes a stroke, and thereby transfers forces to the handle, the hand will be situated on the handle such that the resulting force mainly is directed along the axis of the pole 1, and the forces will not cause any substantial bending moment in the pole. A presupposition for this is, as mentioned, that said distance a is adapted to the user's hand, but under all circumstances any distance a will lead to an improvement relatively to a handle where the axes of the knob and the pole itself, respectively, are coaxial.

The handle according to the invention will normally be provided with a strap, which is not shown in FIG. 2. The strap may in a per se known manner be fastened to the knob 6 (see the strap 3 shown in FIG. 1).

There are no limitations with respect to the choice of material in the handle. It may for instance be made of plastics, rubber, cork, wood or a combination of these or other materials.

In a per se known manner the portion 8 for fastening of the pole 1 has a hole in which the end of the pole is inserted and fastened in a suitable manner.

The handle is not necessarily planar when seen from above or below. The handle may conveniently have a somewhat curved shape when seen from above or below, so that the elements 4.1 and 4.2 are at a small angle to each other, in such a manner that the elements, or at least the element 4.1, slopes slightly forwardly, i.e. in the direction of movement, outwardly from the pole.

In the embodiment of FIG. 2 the upper surfaces 5.1 and 5.2 are slightly curved.

I claim:

1. Ski pole handle device comprising a laterally protruding element which forms a supporting surface for the palm of the hand, wherein the support surface extends slopping downwardly in a direction away from the ski pole, a second element which forms a supporting surface for the thumb protrudes laterally substantially oppositely of the first element, and a knob projects upwardly between said elements, the knob including fastening means for a strap at a position higher than said supporting surfaces.

2. A device according to claim 1, wherein the supporting surface for the palm of the hand slopes under an angle of approximately 60° relatively to the axis of the pole handle device.

3. A device according to claim 1, wherein the thumb supporting element is shorter than the palm supporting element.

4. A device according to claim 1, wherein the elements are formed integrally with a handle sleeve which is used to fasten the pole to the handle device.

5. A device according to claim 4, wherein the knob has an axis, and the sleeve for fastening of the pole is offset laterally relative to the axis of the knob.

6. A device according to claim 5, wherein the distance between said axes is in the range of 5 to 25 mm.

* * * * *

UNITED STATES PATENT AND TRADEMARK OFFICE

CERTIFICATE OF CORRECTION

PATENT NO. : 4,790,562

DATED : December 13, 1988

INVENTOR(S) : Halldor Skard

It is certified that error appears in the above-identified patent and that said Letters Patent is hereby corrected as shown below:

IN THE ABSTRACT:

Line 10, after "strap (3)", and before "fastened", insert:
-- is --;

IN THE SPECIFICATION:

Col. 1, line 23, delete "god", and insert therefor:
-- good --;

IN THE CLAIMS:

Claim 1, line 4, delete "slopping", and insert therefor:
-- sloping --;

Claim 5, line 2, after "pole", and before "is", insert:
-- has an axis that --.

Signed and Sealed this

Eighteenth Day of July, 1989

*Attest:*

DONALD J. QUIGG

*Attesting Officer*

*Commissioner of Patents and Trademarks*